United States Patent [19]

Rioja et al.

[11] Patent Number: 4,869,870

[45] Date of Patent: Sep. 26, 1989

[54] ALUMINUM-LITHIUM ALLOYS WITH HAFNIUM

[75] Inventors: Roberto J. Rioja, Lower Burrell; Philip E. Bretz, Pittsburgh; John Jacoby, Murrysville, all of Pa.

[73] Assignee: Aluminum Company of America, Pittsburgh, Pa.

[21] Appl. No.: 172,504

[22] Filed: Mar. 24, 1988

[51] Int. Cl.[4] ..... C22C 21/00

[52] U.S. Cl. ..... 420/532; 148/439

[58] Field of Search ..... 420/532; 148/439

[56] References Cited

U.S. PATENT DOCUMENTS

| | | | |
|---|---|---|---|
| 2,915,390 | 12/1959 | Criner | 75/141 |
| 4,094,705 | 6/1978 | Sperry et al. | 148/2 |
| 4,571,272 | 2/1986 | Grimes | 148/11.5 |
| 4,582,544 | 4/1986 | Grimes et al. | 148/11.5 |
| 4,603,029 | 7/1986 | Quist et al. | 420/535 |
| 4,626,409 | 12/1986 | Miller | 420/533 |
| 4,636,357 | 1/1987 | Peel et al. | 420/532 |
| 4,648,913 | 3/1987 | Hunt, Jr. et al. | 148/12.7 |

FOREIGN PATENT DOCUMENTS

| | | |
|---|---|---|
| 150456 | 8/1985 | European Pat. Off. . |
| 156995 | 10/1985 | European Pat. Off. . |
| 158769 | 10/1985 | European Pat. Off. . |
| 210112 | 6/1986 | European Pat. Off. . |
| 3613224 | 4/1986 | Fed. Rep. of Germany . |
| 85/02416 | 11/1984 | PCT Int'l Appl. . |
| 1387586 | 3/1975 | United Kingdom . |
| 2127847 | 3/1986 | United Kingdom . |

OTHER PUBLICATIONS

"Microstructure and Toughness of High Strength Aluminum Alloys" by J. T. Staley, ASTM STP605, pp. 71–103.

*Primary Examiner*—R. Dean

*Attorney, Agent, or Firm*—Andrew Alexander

[57] ABSTRACT

An aluminum base alloy suitable for forming into a wrought product having improved combinations of strength and fracture toughness is provided. The alloy is comprised of 0.2 to 5.0 wt. % Li, 0.05 to 6.0 wt. % Mg, 0.2 to 5.0 wt. % Cu, 0 to 2.0 wt. % Mn, 0 to 1.0 wt. % Zr, 0.05 to 12.0 wt. % Zn, 0.05 to 1.0 wt. % Hf, 0.5 wt. % max. Fe, 0.5 wt. % max. Si, the balance aluminum and incidental impurities.

22 Claims, 4 Drawing Sheets

STRENGTH / TOUGHNESS RELATIONSHIP

STRENGTH / TOUGHNESS RELATIONSHIP

Al-2.4% Li-0.3% Cu-2% Mg-0.07% Zr-0.5% Mn-0.3% Hf

Mn dispersoid size = 0.15μm; $\vec{s}$ = 0.06μm

Al-2.2% Li-0.3% Cu-2% Mg-0.09% Zr-0.5% Mn-0.3% Hf-0.18% V

Mn dispersoid size = 0.44μm $\vec{s}$ = 0.11μm

Al-2.8% Li-0.5% Cu-3% Mg-0.13% Zr-0.5% Mn

ALUMINUM-LITHIUM ALLOYS WITH HAFNIUM

BACKGROUND OF THE INVENTION

This invention relates to aluminum base alloys, and more particularly, it relates to improved lithium containing aluminum base alloys, and particularly forged products made therefrom and methods of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

U.S. Pat. No. 4,626,409 discloses aluminum base alloy consisting of, by wt. %, 2.3 to 2.9 Li, 0.5 to 1.0 Mg, 1.6 to 2.4 Cu, 0.05 to 0.25 Zr, 0 to 0.5 Ti, 0.1 to 0.5 Mn, 0 to 0.5 Ni, 0 to 0.5 Cr and 0 to 0.5 Zn and a method of producing sheet or strip therefrom. In addition, U.S. Pat. No. 4,582,54 discloses a method of superplastically deforming an aluminum alloy having a composition similar to that of U.S. Pat. No. 4,626,409. European Patent Application No. 210112 discloses an aluminum alloy product containing 1 to 3.5 wt. % Li, up to 4 wt. % Cu, up to 5 wt. % Mg, up to 3 wt. % Zn and Mn, Cr and/or Zr additions. The alloy product is recrystallized and has a grain size less than 300 micrometers. U.S. Pat. No. 4,648,913 discloses aluminum base alloy wrought product having improved strength and fracture toughness combinations when stretched, for example, an amount greater than 3%.

EPA 158,769 discloses a low density aluminum base alloy consisting essentially of 2.7–5 wt. % Li, 0.5–8 wt. % Mg, 0.25 wt. % Zr, at least one element selected from the group consisting of Cu, Si, Sc, Ti, V, Hf, Be, Cr, Mn, Fe, Co and 0.5–5 wt. % Ni, the balance aluminum.

British Patent No. 1,387,586 discloses a superplastic aluminum base alloy containing 1.75 to 10 wt. % Cu, 0–2 wt. % Mg and 0–1.5 Si, and British Patent No. 1,596,918 discloses similar compositions containing 1–3 wt. % Hf.

U.S. Pat. No. 4,094,705 discloses aluminum base alloy containing 0.3–1 wt. % Li, 1 to 5 wt. % Mg, up to 0.3 wt. % Ti, up to 1.0 wt. % Mn and up to 0.2 wt. % V.

The present invention provides improved lithium containing aluminum base alloys which include forged products having improved strength characteristics while retaining high toughness properties.

SUMMARY OF THE INVENTION

A principal object of this invention is to provide in improved lithium containing aluminum base alloys.

Another object of this invention is to provide an improved aluminum-lithium alloy wrought product having improved strength and toughness characteristics.

And yet another object of this invention includes providing lithium containing aluminum base alloy suitable for forged products having improved strength and fracture toughness properties.

These and other objects will become apparent from the specification, drawings and claims appended hereto.

In accordance with these objects, an aluminum base alloy suitable for forming into a wrought product having improved combinations of strength and fracture toughness is provided. The alloy is comprised of 0.2 to 5.0 wt. % Li, 0.05 to 6.0 wt. % Mg, 0.2 to 5.00 wt. % Cu, 0.05 to 0.12 wt. % Zr, 0.05 to 12.0 wt. % Zn, 0.05 to 1.0 wt. % Hf, 0.1 wt. % max. Mn, 0.2 wt. % max. V, 0.5 wt. % max. Fe, 0.5 wt. % max. Si, the balance aluminum and incidental impurities.

DETAILED DESCRIPTION OF THE PREFERRED EMBODIMENTS

Figure 1:
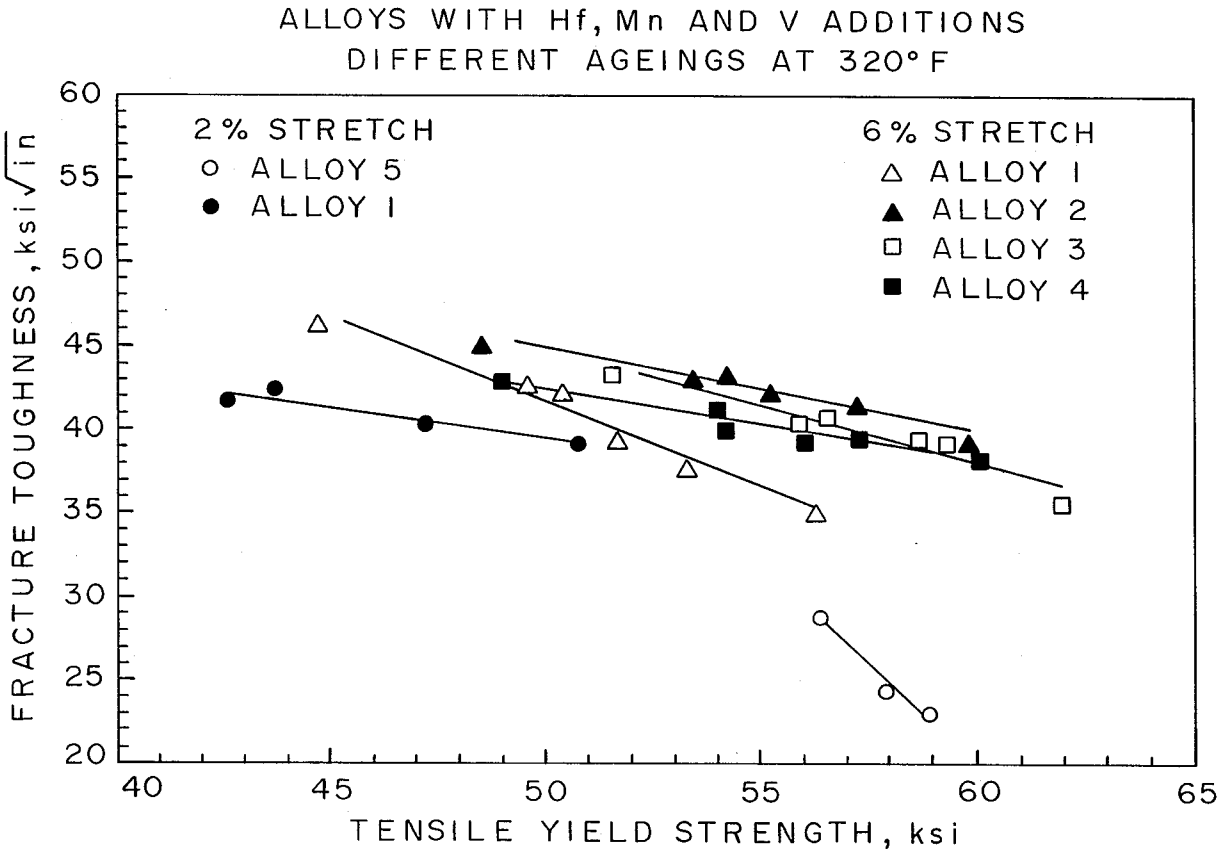
FIG. 1 shows the results of toughness plotted against tensile strength of alloys in accordance with the invention.

The alloy of the present invention can contain 0.2 to 5.0 wt. % Li, 0.5 to 6.0 wt. % Mg, 0.2 to 5.0 wt. % Cu, 0.05 to 12 wt. % Zn, 0.05 to 0.14 wt. % Zr, 0.05 to 1.0 wt. % Hf, 0.9 wt. % max. Mn, 0.2 wt. % max. V, 0.5 wt. % max. Fe, 0.5 wt. % max. Si, the balance aluminum and incidental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 1.5 to 3.0 wt. % Li, 1.5 to 3.0 wt. % Cu, 0.2 to 2.5 wt. % Mg, 0.2 to 11 wt. % Zn, 0.08 to 0.12 wt. % Zr, 0.08 to 0.6 wt. % Hf, the balance aluminum and impurities as specified above. A typical alloy composition would contain 1.8 to 2.5 wt. % Li, 2.55 to 2.9 wt. % Cu, 0.2 to 2.0 wt. % Mg, 0.2 to 2.0 wt. % Zn, 0.08 to 0.6 wt. % Hf, greater than 0.04 to less than 0.16 wt. % Zr, and max. 0.1 wt. % of each of Fe and Si. Vanadium may be added to these compositions in the range of 0.03 to 0.3 wt. %, preferably in the range of 0.05 to 0.2 wt. %, particularly when the use is for products such as forged automotive wheels. Hafnium can be effective when its level is 0.12 to 0.16 wt. %. Hafnium and vanadium are particularly important, especially as they affect the microstructure in the presence of zirconium, as explained hereinafter.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the limits of copper, since excessive amounts, for example, can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the limits set forth for magnesium because excess magnesium, for example, can also lead to interference with fracture toughness, particularly through the formation of undesirable phases at grain boundaries.

Zirconium is the preferred material for grain structure control. However, other grain structure control materials can include Sc, Cr, Mn and Ti typically in the range of 0.05 to 0.2 wt. % with Mn up to 2.0 wt. % but typically up to 0.6 wt. %. The use of zinc results in increased levels of strength, particularly in combination with magnesium. However, excessive amounts of zinc can impair toughness through the formation of intermetallic phases.

Zinc is important because, in this combination with magnesium, it results in an improved level of strength which is accompanied by high levels of corrosion resistance when compared to alloys which are zinc free. Particularly effective amounts of Zn are in the range of 0.1 to 1.0 when the magnesium is in the range of 0.05 to 0.5 wt. %. The Mg to Zn ratio can be in the range of about 0.1 to 6.0; however, it is preferred to keep this ratio less than 1.0, particularly when Mg is in the range of 0.1 to 1.0 wt. %.

Working within these Mg/Zn ratios is important in that it aids in the worked product being less anisotropic or more isotropic in nature, i.e., properties more uniform in all directions. That is, working within these Mg/Zn ranges can result in the end product having greatly reduced hot worked texture, resulting from rolling, for example, to provide improved properties, for example in the 45° direction.

While the inventors do not wish to be bound by any theory of invention, it is believed that the Hf and V are significant in that Hf modifies the composition of the $L_{12}$ (crystal structure) $Al_{13}Zr$ dispersoids. Furthermore, V additions refine the size and distribution of Mn bearing dispersoids. This is significant in that more recrystallization retarding material can be added without affecting toughness to provide a substantially unrecrystallized product or a very finely recrystallized product, e.g., typical grain size less than 5 microns. That is, while zirconium is very effective in retarding recrystallization, too much zirconium leads to the formation of large equilibrium $Al_3Zr$ particles and, therefore, lowers toughness. The addition of Hf results in the formation of small (about 500 Angstroms) spherical dispersoids with the $Ll_2$ structure. This increase in volume fraction of dispersoids can result in a microstructure having improved resistance to recrystallization without a decrease in fracture toughness. Also, it is believed that the addition of V homogenizes the distribution of $Al_3(Zr, Hf)$ dispersoids and also refines the size of Mn bearing dispersoids. This improvement in the microstructure can also add to the recrystallization resistance of the alloy and improve elevated temperature performance of the alloy.

Toughness or fracture toughness as used herein refers to the resistance of a body, e.g. castings, extrusions, forgings, sheet or plate, to the unstable growth of cracks or other flaws.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about 1/4 to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable.

After the homogenizing treatment, the metal can be rolled or extruded or otherwise subjected to working operations to produce stock such as sheet, plate or extrusions, a forged product or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F. Preferably, the metal temperature initially is in the range of 900° to 975° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.10 inch.

After rolling a body of the alloy to the desired thickness, the sheet or plate or other worked article is subjected to a solution heat treatment to dissolve soluble elements. The solution heat treatment is preferably accomplished at a temperature in the range of 900° to 1050° F. and preferably produces an unrecrystallized grain structure.

Solution heat treatment can be performed in batches or continuously, and the time for treatment can vary from hours for batch operations down to as little as a few seconds for continuous operations. Basically, solution effects can occur fairly rapidly, for instance in as little as 30 to 60 seconds, once the metal has reached a solution temperature of about 1000° to 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature, and accordingly, solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times.

To further provide for the desired strength and fracture toughness, as well as corrosion resistance, necessary to the final product and to the operations in forming that product, the product should be rapidly quenched to prevent or minimize uncontrolled precipitation of strengthening phases.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 95 ksi. However, the useful strengths are in the range of 50 to 85 ksi and corresponding fracture toughnesses are in the range of 25 to 75 ksi in. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. Also, while reference has been made herein to single aging steps, multiple aging steps, such as two or three aging steps, are contemplated and stretching or its equivalent working may be used prior to or even after part of such multiple aging steps.

With respect to a forged product, the alloy has the advantage that it is capable of providing an unrecrystallized forged product having much greater strength than a recrystallized product. Further, the sheet or plate product can be provided in unrecrystallized form thereby providing improvements in strength and fracture toughness.

By use of unrecrystallized herein is meant unrecrystallized grain structure as well as very fine recrystallized grain structure having grains less than 5 microns.

The following example is further illustrative of the invention:

EXAMPLE

Five alloys were prepared having the following compositions:

| Alloy | % Li | % Cu | % Mg | % Zr | % Mn | % Hf | % V | Density |
|---|---|---|---|---|---|---|---|---|
| 1 | 2.4 | 0.2 | — | 0.11 | 0.5 | 0.25 | — | 0.0911 |
| 2 | 2.4 | 0.2 | 1 | 0.11 | 0.5 | 0.24 | — | 0.0909 |
| 3 | 2.4 | 0.3 | 2 | 0.07 | 0.5 | 0.30 | — | 0.0905 |
| 4 | 2.2 | 0.3 | 2 | 0.09 | 0.5 | 0.29 | 0.18 | 0.0910 |
| 5 | 2.8 | 0.5 | 3 | 0.13 | 0.5 | — | — | 0.0902 |

The alloys were cast into ingots suitable for rolling. The ingots were homogenized at 950° F. for 8 hours followed by 24 hours at 1000° F., hot rolled and solution heat treated for one hour at 1020° F. for 12 hours. FIG. 1 shows the results of toughness plotted against tensile strength and that the alloy having hafnium and manganese additions had improved strengths and fracture toughness.

Figure 2:
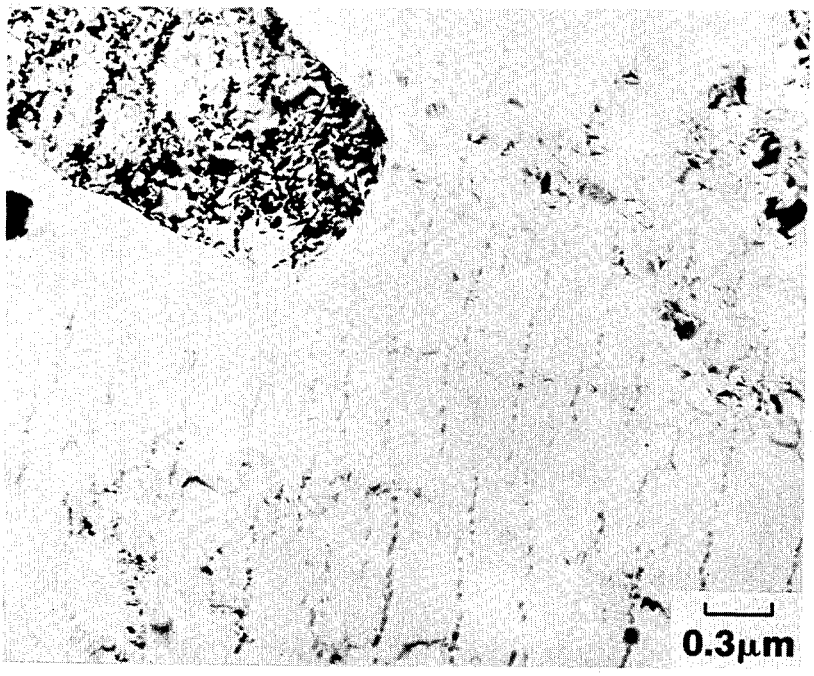
FIG. 2 shows strings or lines of zirconium or hafnium dispersoids.
Figure 3:
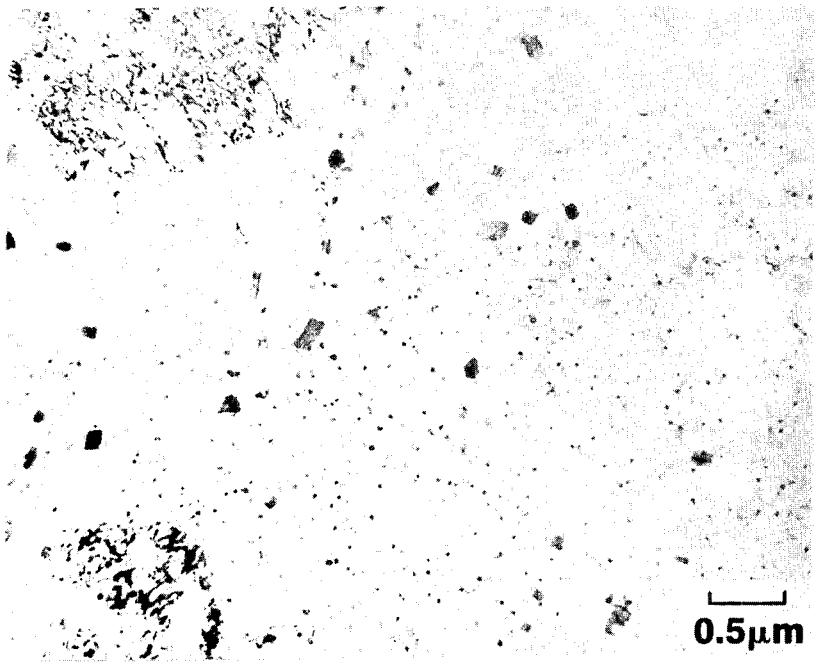
FIG. 3 shows the results of vanadium added in accordance with the invention.
Figure 4:
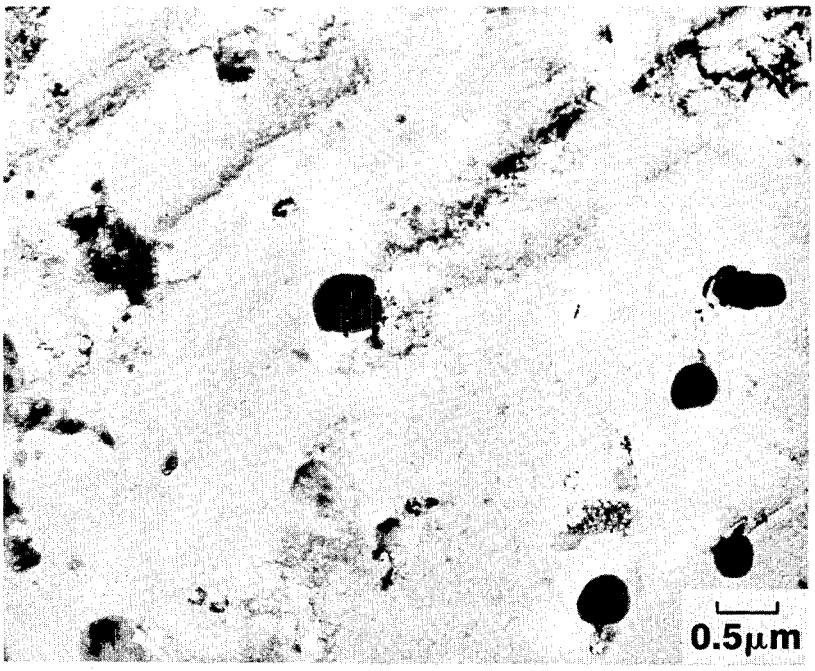
FIG. 4 shows large manganese dispersoid which results when vanadium is not added.

Further, alloy 4, the microstructure of which is shown in FIG. 3, shows the results of adding vanadium. That is, FIG. 2 shows strings or lines of Zr and Hf dispersoids, and FIG. 3 shows that with the addition of vanadium the strings have been transformed into a uniform and homogeneous distribution of dispersoids, resulting in an improved alloy. Also, it has bee discovered that vanadium has the effect of modifying Mn containing dispersoids. That is, Mn containing dispersoids of average size of 0.44 microns where reduced to 0.15 microns on the addition of vanadium. This result is shown in FIGS. 3 and 4 which correspond to alloys 4 and 5. It will be appreciated that Hf does not affect Mn bearing dispersoid.

While the invention has been described in terms of preferred embodiments, the claims appended hereto are intended to encompass other embodiments which fall within the spirit of the invention.

What is claimed is:

1. An aluminum base alloy suitable for forming into a wrought product having improved combinations of strength and fracture toughness, the alloy consisting essentially of 0.2 to 5.0 wt. % Li, 0.05 to 6.0 wt. % Mg, 0.2 to 5.0 wt. % Cu, 0 to 2.0 wt. % Mn, 0 to 1.0 wt. % Zr, 0.05 to 12.0 wt. % Zn, 0.05 to 1.0 wt. % Hf, 0.5 wt. % max. Fe, 0.5 wt. % max. Si, the balance aluminum and incidental impurities.

2. The alloy in accordance with claim 1 wherein Li is in the range of 1.0 to 4.0 wt. %.

3. The alloy in accordance with claim 1 wherein Cu is in the range of 1.0 to 5.0 wt. %.

4. The alloy in accordance with claim 1 wherein Li in the range of 1.5 to 3.0 wt. %.

5. The alloy in accordance with claim 1 wherein Li is in the range of 1.8 to 2.5 wt. %.

6. The alloy in accordance with claim 1 wherein Cu is in the range of 1.5 to 3.0 wt. %.

7. The alloy in accordance with claim 1 wherein Cu is in the range of 2.5 to 3.0 wt. %.

8. The alloy in accordance with claim 1 wherein Mg is in the range of 0.2 to 2.5 wt. %.

9. The alloy in accordance with claim 1 wherein Mg is in the range of 0.2 to 2.0 wt. %.

10. The alloy in accordance with claim 1 wherein Zn is in the range of 0.2 to 11.0 wt. %.

11. The alloy in accordance with claim 1 wherein Zn is in the range of 0.2 to 2.0 wt. %.

12. The alloy in accordance with claim 1 wherein Zr is in the range of 0.06 to 0.12 wt. %.

13. The alloy in accordance with claim 1 wherein Hf is in the range of 0.08 to 0.6 wt. %.

14. The alloy in accordance with claim 1 which includes V in the range of 0.05 to 0.2.

15. The alloy in accordance with claim 1 which includes Mn in the range of 0 to 0.6.

16. An aluminum base alloy suitable for forming into a wrought product having improved combinations of strength and fracture toughness, the alloy consisting essentially of 1.5 to 3.0 wt. % Li, 0.2 to 2.5 wt. % Mg, 1.5 to 3.0 wt. % Cu, 0.08 to 0.12 wt. % Zr, 0.2 to 11.0 wt. % Zn, 0.08 to 0.12 wt. % Hf, 0.03 to 0.3 wt. % Mn, 0.5 wt. % max. Fe, 0.5 wt. % max. Si, the balance aluminum and incidental impurities.

17. An aluminum base alloy suitable for forming into a wrought product having improved combinations of strength and fracture toughness, the alloy consisting essentially of 1.8 to 2.5 wt. % Li, 0.2 to 2.0 wt. % Mg, 2.5 to 3.0 wt. % Cu, 0.08 to 0.12 wt. % Zr, 0.2 to 2.0 wt. % Zn, 0.08 to 0.15 wt. % Hf, 0.5 wt. % max. Fe, 0.25 wt. % max. Ti 0.5 wt. % max. Si, the balance aluminum and incidental impurities.

18. The alloy in accordance with claim 15 wherein V is in the range of 0.05 to 0.2 wt. %.

19. The alloy in accordance with claim 16 wherein V is in the range of 0.05 to 0.2 wt. %.

20. An aluminum base alloy suitable for forming into a wrought product having improved combinations of strength and fracture toughness, the alloy consisting essentially of 0.2 to 5.0 wt. % Li, 0.05 to 6.0 wt. % Mg, 0.2 to 5.0 wt. % Cu, 0 to 2.0 wt. % Mn, 0 to 1.0 wt. % Zr, 0.05 to 12.0 wt. % Zn, 0.05 to 0.3 wt. % V, 0.05 to 1.0 wt. % Hf 0.5 wt. % max. Fe, 0.5 wt. % max. Si, the balance aluminum and incidental impurities.

21. An aluminum base alloy suitable for forming into a wrought product having improved combinations of strength and fracture toughness, the alloy consisting essentially of 1.5 to 3.0 wt. % Li, 0.2 to 2.5 wt. % Mg, 1.5 to 3.0 wt. % Cu, 0.08 to 0.12 wt. % Zr, 0.2 to 11.0 wt. % Zn, 0.05 to 0.2 wt. % V, 0.05 to 1.0 wt. % Hf0.03 to 0.3 wt. % Mn, 0.5 wt. % max. Fe, 0.5 wt. % max. Si, the balance aluminum and incidental impurities.

22. An aluminum base alloy suitable for forming into a wrought product having improved combinations of strength and fracture toughness, the alloy consisting essentially of 1.8 to 2.5 wt. % Li, 0.2 to 2.0 wt. % Mg, 2.5 to 3.0 wt. % Cu, 0.08 to 0.12 wt. % Zr, 0.2 to 2.0 wt. % Zn, 0.05 to 0.2 wt. % V, 0.05 to 1.0 wt. % Hf 0.5 wt. % max. Fe, 0.25 wt. % max. Ti 0.5 wt. % max. Si, the balance aluminum and incidental impurities.

* * * * *